US006502534B2

(12) United States Patent
Feyerl et al.

(10) Patent No.: US 6,502,534 B2
(45) Date of Patent: Jan. 7, 2003

(54) ELECTROMAGNETIC ACTUATOR FOR OPERATING A CYLINDER VALVE OF AN INTERNAL COMBUSTION ENGINE

(75) Inventors: Günter Feyerl, Alsdorf (DE); Michael Schebitz, Eschweiler (DE); Hans-Peter Schmitt, Ebsdorfergrund (DE); Lutz Fischer, Simmerath (DE)

(73) Assignee: FEV Motorentechnik GmbH (DE)

( * ) Notice: Subject to any disclaimer, the term of this patent is extended or adjusted under 35 U.S.C. 154(b) by 0 days.

(21) Appl. No.: 09/834,902

(22) Filed: Apr. 16, 2001

(65) Prior Publication Data

US 2001/0047779 A1 Dec. 6, 2001

(30) Foreign Application Priority Data

Apr. 15, 2000 (DE) ..... 100 18 739

(51) Int. Cl.[7] ..... F01L 9/04
(52) U.S. Cl. ..... 123/90.11
(58) Field of Search ..... 123/90.11

(56) References Cited

U.S. PATENT DOCUMENTS 6,164,253 A * 12/2000 Alberter et al. ..... 123/90.11

6,199,843 B1 * 5/2001 DeGrace ..... 267/179

* cited by examiner

*Primary Examiner*—Thomas Denion
(74) *Attorney, Agent, or Firm*—Venable, Baetjer, Howard & Civiletti, LLP; Norman N. Kunitz

(57) ABSTRACT

An electromagnetic actuator for operating a cylinder valve in an internal combustion engine includes first and second housings secured to one another. Each housing has a cavity and a through bore extending therefrom. First and second electromagnets are disposed in the cavity of the respective housings. Each electromagnet has a yoke, a coil and a pole face. The pole faces are oriented toward and spaced from one another, and a reciprocating armature is disposed between the pole faces. A spring which urges the armature away from the first electromagnet has an end oriented away from the armature. A support cap is axially insertable in the through bore of the first electromagnet and includes a cap base having an inner face supporting the spring end. A locking arrangement secures the support cap to the housing and has a component axially insertable in the through bore with the support cap.

19 Claims, 6 Drawing Sheets

ELECTROMAGNETIC ACTUATOR FOR OPERATING A CYLINDER VALVE OF AN INTERNAL COMBUSTION ENGINE

CROSS REFERENCE TO RELATED APPLICATION

This application claims the priority of German Application No. 100 18 739.0 filed Apr. 15, 2000, which is incorporated herein by reference.

BACKGROUND OF THE INVENTION

An electromagnetic actuator for operating a cylinder valve of a piston-type internal-combustion engine has to be mass produced in large numbers in an economical manner. Such an electromagnetic actuator includes opening and closing electromagnets having spaced, facing pole faces, an armature reciprocated between the pole faces and coupled to the cylinder valve to move the latter into open and closed positions, as well as opening and closing (resetting) springs opposing the armature motion.

German Offenlegungsschrift (application published without examination) 198 25 728 discloses an electromagnetic actuator of the above-outlined type. The electromagnets are each provided with a respective, separate housing for receiving the magnet yoke which supports a coil. Such housings make possible a mass produced assembly of complete electromagnetic actuators. The housings are expediently made of a non-magnetic metal, for example, aluminum or an aluminum alloy so that they may be mass produced with a suitable casting process (such as die casting) in large numbers in an economical manner and adapted to individual requirements. On its side oriented away from the pole face of the inserted yoke body, the housing is provided with a tubular passage for receiving one end of a resetting spring. Thus, each housing may be used either for the part serving the opening function or the part serving the closing function.

In the housing oriented towards the cylinder valve the closing spring extends through the housing passage and is supported at its ends by the engine block and, respectively, by a spring seat disk affixed to the cylinder valve stem.

In the housing oriented away from the cylinder valve the opening spring passes through the housing passage and is supported on a threaded sleeve, by means of which the mid position of the armature between the pole faces of the two electromagnets may be adjusted. Such a threaded sleeve involves not only high manufacturing and assembly costs but also has disadvantages as concerns the reproducibility of an optimal setting and its handling during maintenance work.

SUMMARY OF THE INVENTION

It is an object of the invention to provide an improved electromagnetic actuator of the above-outlined type from which the discussed disadvantages are eliminated.

This object and others to become apparent as the specification progresses, are accomplished by the invention, according to which, briefly stated, the electromagnetic actuator for operating a cylinder valve in an internal combustion engine includes first and second housings secured to one another. Each housing has a cavity and a through bore extending therefrom. First and second electromagnets are disposed in the cavity of the respective housings. Each electromagnet has a yoke, a coil and a pole face. The pole faces are oriented toward and spaced from one another, and a reciprocating armature is disposed between the pole faces. A spring which urges the armature away from the first electromagnet has an end oriented away from the armature. A support cap is axially insertable in the through bore of the first electromagnet and includes a cap base having an inner face supporting the spring end. A locking arrangement secures the support cap to the housing and has a component axially insertable in the through bore with the support cap.

By eliminating the conventional, disadvantageous threaded sleeve, both actuator housings may be made from identical blanks without major finishing costs. By using an axially insertable support cap including a plug-in lock, cutting threads into the housing for a threaded adjusting sleeve cooperating with the opening spring is no longer needed. Merely geometrical elements for a plug-in lock are needed which may be readily formed in the housing blank. The presence of such housing configuration is harmless for the other, cap-less housing (accommodating the opening magnet) because, as concerns the opening magnet, only the closing spring is received in the housing passage and therefore any particular housing shape required for the support cap does not cause disturbance during service. Plug-in support bodies may be installed in a simple manner and further have the advantage that they may be made in large numbers of shaped steel sheet. Making the support cap from steel sheet also has the advantage that the cap, although exposed to high tension forces, may be relatively thin-walled. A further advantage compared to a conventional thread provided in the actuator housing resides in the fact that the securing and locking means can be made as large-area members so that the securing means of the steel supporting cap and the housing (such as an aluminum casting) may engage one another with a low surface pressure.

According to a preferred embodiment of the invention, in the region of the through bore the support cap and the housing together form the support cap lock which immobilizes the support cap in the actuator housing. This is achieved by configuring the lock as a bayonet lock composed of at least one radial projection and a receiving element for accommodating the projection, provided, for example, on the outer surface of the support cap and the housing, respectively. Upon assembly, the support cap may be plugged into the housing passage (through bore) and is thereafter rotated about its axis to lock it in place.

According to a particularly advantageous feature of the invention the projection and/or the projection receiving element is configured as a helical ramp in relation to the longitudinal actuator axis. As a result, by rotating the support cap relative to the housing, the bias of the opening spring may be changed and thus the mid position of the armature between the two pole faces may be adjusted. According to the invention, securing means are provided for fixing the support cap in the housing in a predeterminable position of installation.

According to a further advantageous feature of the invention, the outer surface of the cap base whose inner bottom surface is engaged by the opening spring is provided with at least one element for receiving a mounting tool. Such an element may be a rectangular opening provided in the cap base or two openings radially spaced from the central axis of the supporting cap to receive, respectively, a quadrilateral wrench or a hook wrench. After inserting the supporting cap into the housing bore while compressing the opening spring, the support cap may be turned into its locked position by the wrench inserted into the receiving element.

In accordance with a further advantageous feature of the invention, at least the base of the support cap made of steel sheet is tempered (hardened). The opening spring engages at one end a spring seat disk which is made of a wear resistant material and which is affixed to an armature guide bar. The other end of the opening spring engages the inner surface of the cap base. Since at that location substantial spring forces have to be taken up and the support of the springs in operation is exposed to a fluctuating pressing load, a hardened cap base prevents the spring end from working itself into the cap material.

Instead of providing a helical ramp for the projection and/or the projection-receiving element of the bayonet lock for the support cap, according to another feature of the invention at least one adjusting washer is positioned on the inner face of the cap base for engaging the opening spring. By inserting adjusting washers of different thicknesses or as a stack, it is possible to adjust, within the required accuracy, the mid position of the armature between the two pole faces. By virtue of this measure the structure of the lock between the support cap and the housing is simplified since the support cap needs only to be inserted into the housing bore and then locked to the housing by rotation.

DESCRIPTION OF THE PREFERRED EMBODIMENTS

Figure 1:
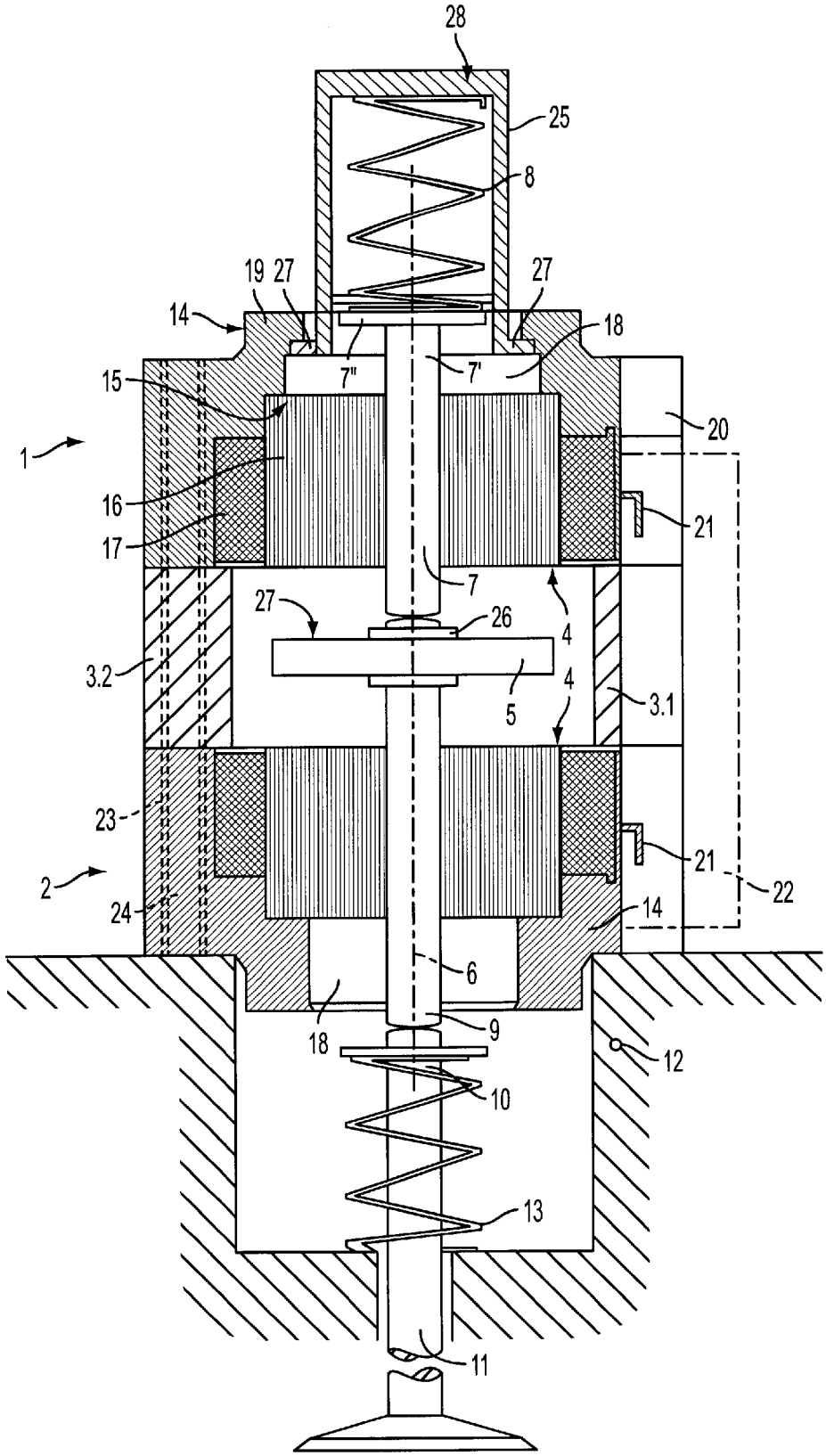
FIG. 1 is an axial sectional view of an electromagnetic cylinder valve actuator incorporating the invention.

The electromagnetic actuator illustrated in FIG. 1 includes a closing electromagnet 1 and an opening electromagnet 2. The magnets 1, 2 which are separated from one another by spacer members 3.1 and 3.2 have respective pole faces 4 oriented toward one another. In the space between the two pole faces 4 an armature 5 is movable from one pole face to the other and is attached to a guide bar 6 passing through the electromagnet 2. In the illustrated embodiment the armature 5 has a rectangular outline.

A further guide bar 7 passes through the electromagnet 1 in aligned contact with the guide bar 6. At its upper end 7' the guide bar 7 is connected with a resetting spring 8 which serves as an opening spring. The lower free end 9 of the guide bar 6 engages the upper free end 10 of the valve stem 11 of a valve which is guided in an only symbolically shown cylinder head 12 of an internal combustion engine. By means of a resetting spring 13 which serves as a closing spring, the cylinder valve is urged in the closing direction. The closing spring 13 and the opening spring 8 exert their spring force in facing, opposite directions whereby in the de-energized state of the electromagnets 1 and 2 the armature 5 assumes its position of rest in the mid region between the two pole faces 4 of the electromagnets 1 and 2, as illustrated in FIG. 1.

In case the two electromagnets 1 and 2 are alternatingly energized, the armature 5 alternatingly arrives at the respective pole face 4 of the two electromagnets 1 and 2 and, accordingly, the cylinder valve is, for the duration of the energization, maintained in the open position (engagement of the armature 5 with the pole face 4 of the electromagnet 2) against the force of the closing spring 13 or in the closed position (engagement of the armature 5 with the pole face 4 of the electromagnet 1) against the force of the opening spring 8.

The electromagnetic actuator illustrated in FIG. 1 is a structural unit composed of practically identical modular elements. The two electromagnets are preferably of identical construction and are each composed essentially of a separate housing 14 which has a cavity 15 oriented towards the armature 5 for receiving a yoke body 16 carrying a coil 17. The housing 14 further has a through bore 18 through which the respective opening spring 8 or closing spring 13 may partially pass.

Figure 2:
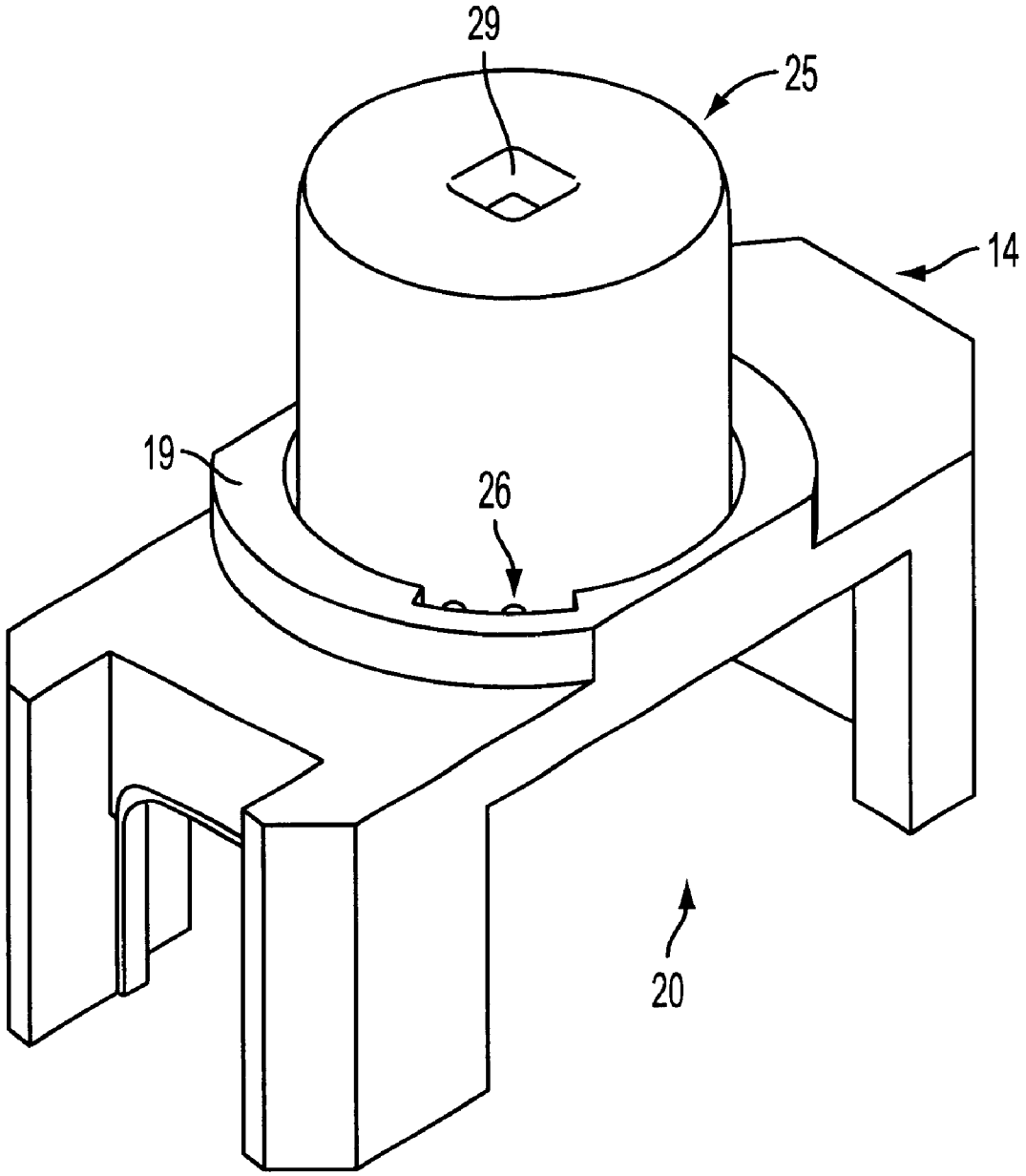
FIG. 2 is a perspective view of a housing for the closing magnet of the actuator, provided with a support cap for the opening spring according to a preferred embodiment of the invention.

As indicated by the flatness of the actuator housing 14 shown in FIG. 2, the electromagnetic actuator is of very narrow construction allowing a close, side-by-side installation of such actuators in the limited space of the engine. The yoke body 16 is, together with the coil 17, inserted into the cavity 15 of the housing 14 and is fixed and held therein by means of a suitable cast mass.

The housing 14 further has an additional lateral opening 20 which permits access to the terminals 21 of the coil 17. By virtue of such an arrangement the two electromagnets 1, 2 may be connected to the actuator control by a coded, one-piece plug 22 (shown in dash-dot lines) in a non-interchangeable manner. The plug 22 is positioned and protected in the lateral flanks of the lateral opening 20.

Reverting to FIG. 1, the two housings 14 made, for example, of an aluminum alloy by means of die casting, have aligned passages 23 which extend parallel to the axis of the guide bars 6 and 7 and cooperate with similar apertures provided in spacers 3.1 and 3.2 positioned between the two housings 14. The two housings 14 may thus be firmly bolted to one another and/or to the engine block 12 with the interposition of the spacers 3.1 and 3.2.

The opening spring 8 is supported by a support cap 25 serving as a spring-force setting element. By turning the support cap 25 or by inserting adjusting washers, the mid position of the armature 5 between the two pole faces 4 may be altered.

Figure 3:
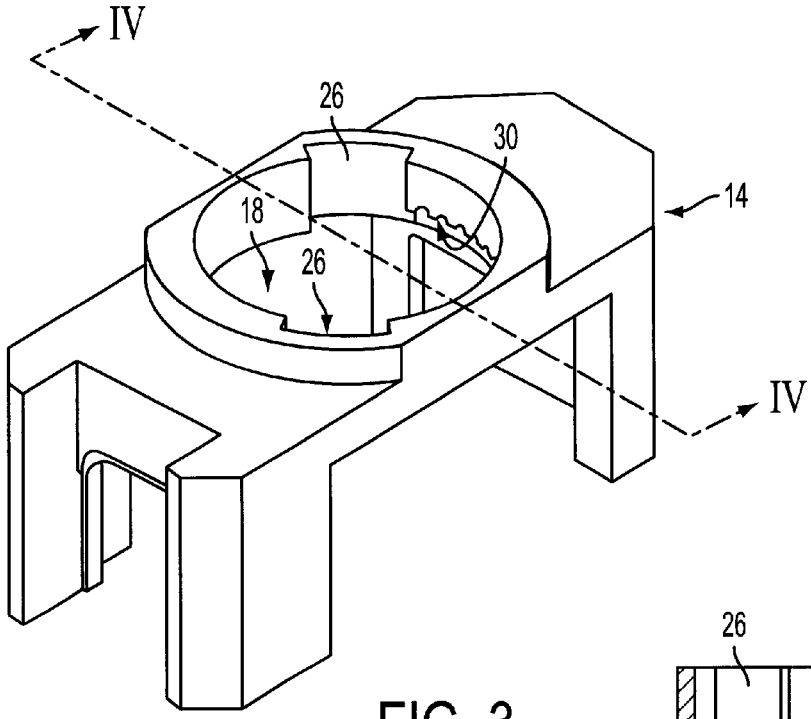
FIG. 3 shows the magnet housing of FIG. 2 without the support cap.
Figure 5:
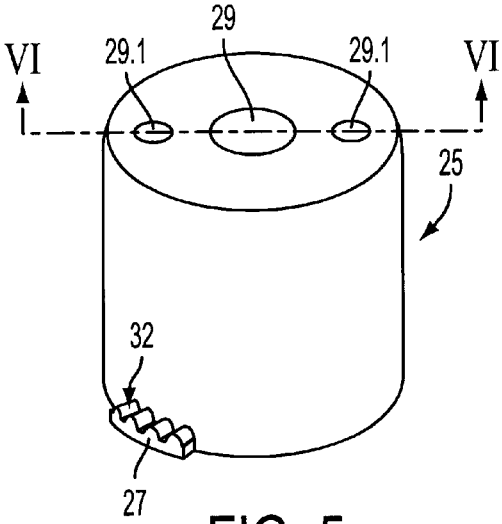
FIG. 5 is a perspective view of the support cap shown in FIG. 2.
Figure 6:
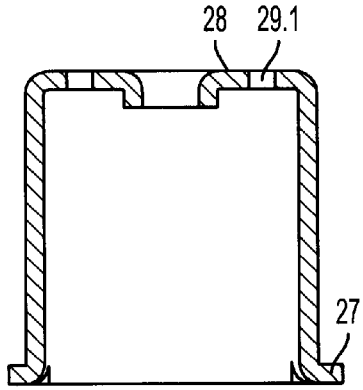
FIG. 6 is a sectional view taken along line VI—VI of FIG. 5.
Figure 7:
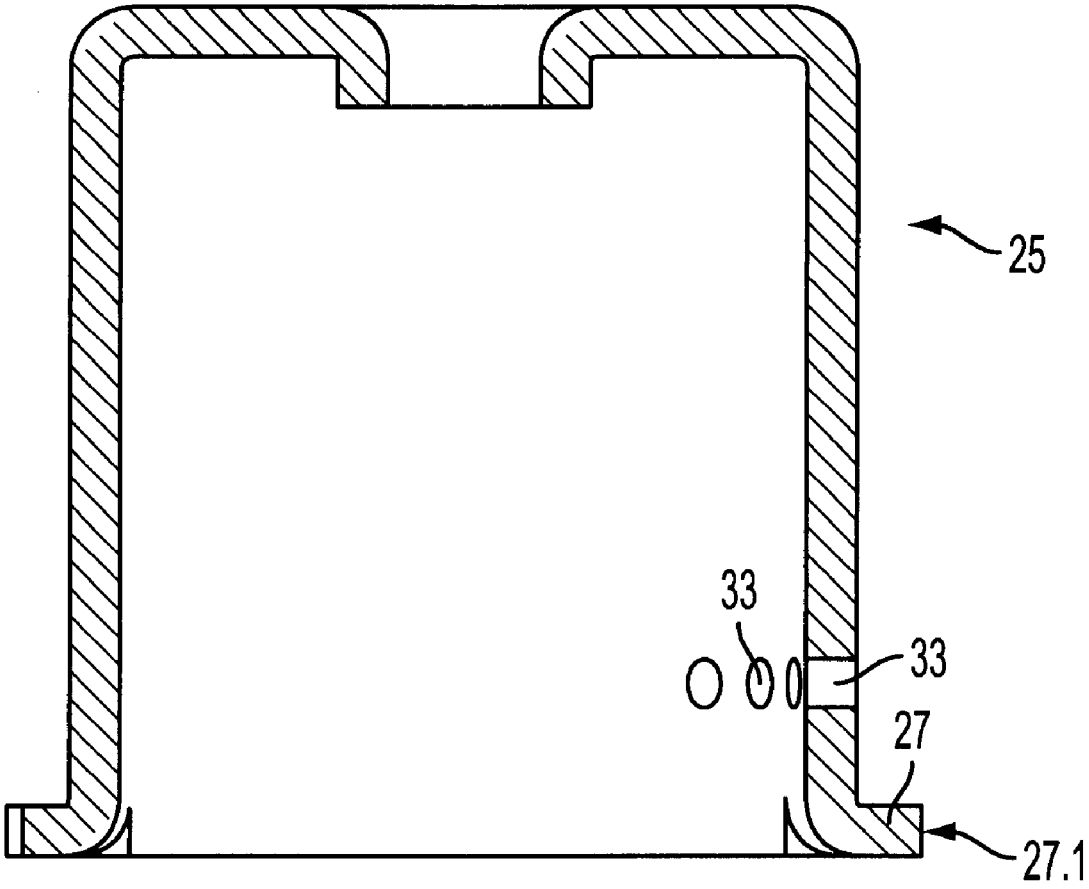
FIG. 7 is a sectional elevational view of a support cap according to a variant of the FIG. 6 structure.

As may be seen in FIG. 1 and particularly in FIG. 2, the through bore 18 is surrounded by a flange 19 at its end oriented away from the yoke body 16. Also referring to FIG. 3, on the inside the through bore 18 is, on diametrically opposite sides, provided with groove-like recesses 26 cooperating with respective, radially outwardly oriented projections 27 provided on the support cap 25, as also shown in FIGS. 5, 6 and 7. By virtue of this structure the support cap 25 may be inserted axially into the through bore 18 and then rotated to be immobilized in the housing 14 by a bayonet-type lock. Upon insertion of the support cap 25, the opening spring 8, previously positioned on a spring seat disk 7" affixed to the upper end 7' of the guide bar 7, is compressed. By virtue of the bias of the opening spring 8 the support cap 25 is held in its position even when the armature 5 is in engagement with the pole face 4 of the opening magnet 2.

The base 28 of the support cap 25 is provided with a polygonal (for example, rectangular, as shown in FIG. 2) aperture 29 for receiving a non-illustrated turning tool to rotate the support cap 25 after it has been inserted into the through bore 18.

In actuator constructions in which the upper end of the guide rod 7 passes through the opening spring 8 and through the base 28 of the support cap 25 and is provided with sensor elements, the through aperture 29 is circular. In such a case, as illustrated in FIG. 5, as tool receptors spaced bore holes 29.1 are provided into which a suitable hook wrench may be inserted for turning the support cap 25.

Figure 4:
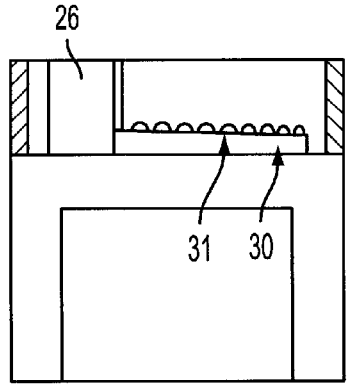
FIG. 4 is a sectional view taken along line IV—IV of FIG. 3.

The embodiment illustrated in FIG. 2 is shown in detail in FIGS. 4 and 5 and will be further described as the specification progresses.

As may observed in FIG. 4, adjacent the groove like recesses 26 the lower edge 30 of the through bore 18 has an undercut which is configured as a helical ramp 31 provided with a plurality of consecutive depressions.

Correspondingly, as seen in FIG. 5, the projections 27 have nose-like elevations 32 which may be brought into engagement with the depressions on the ramp 31 by rotating the support cap 25 in the through bore 18. By virtue of the slope of the ramp 31 the distance of the cap base 28 changes relative to the pole face 4 of the closing magnet 1 in the shortening direction if, after insertion of the support cap 25 the latter is turned clockwise. As a result, the bias of the opening spring 8 is increased and, accordingly, the armature 5 is shifted in the direction of the pole face 4 of the opening magnet 2, simultaneously compressing the closing spring 13. By virtue of the engagement of the nose-shaped elevations 32 into the depressions on the ramp 31, the support cap 25 is immobilized in the housing 14 and thus securely prevented from rotating.

Instead of depressions on the helical ramp 31 and corresponding nose-like elevations 32 on the support cap 25, it is feasible to configure the ramp 31 as well as the projection 27 to have a smooth surface as shown in FIG. 7. The angular immobilization of the support cap 25 after adjustment of the mid position of the armature 5 may be effected by a plug-in pin which passes through radial bores 33 in the support cap and corresponding, non-illustrated radial holding bores in the housing flange 19. It is also feasible, however, to provide the edge 27.1 of the projections 27 with a series of tooth-like recesses associated with at least one holding bore passing axially parallel through the flange 19. Thus, after setting the mid position of the armature by turning the support cap 25 in the appropriate angular position, the support cap 25 may be angularly immobilized by a pin passing through the holding bore in the flange 19 and a corresponding, axially parallel bore in the edge 27.1 of the projection 27.

Figure 8:
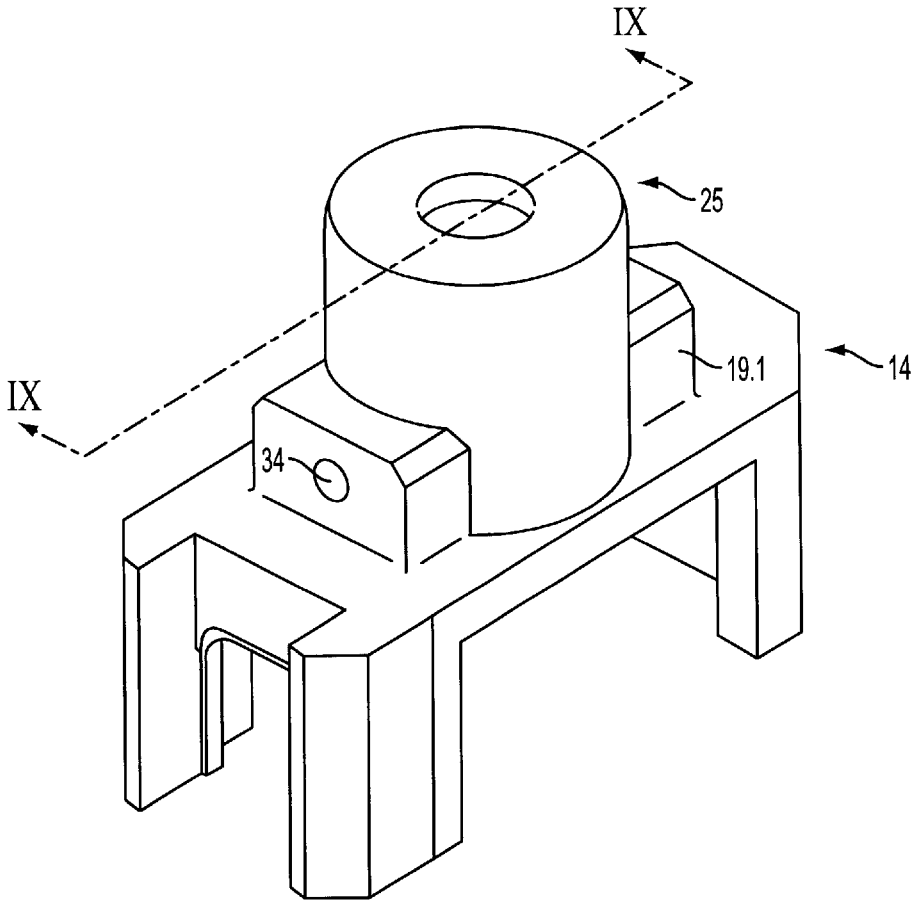
FIG. 8 is a perspective view of another preferred embodiment of the invention.
Figure 9:
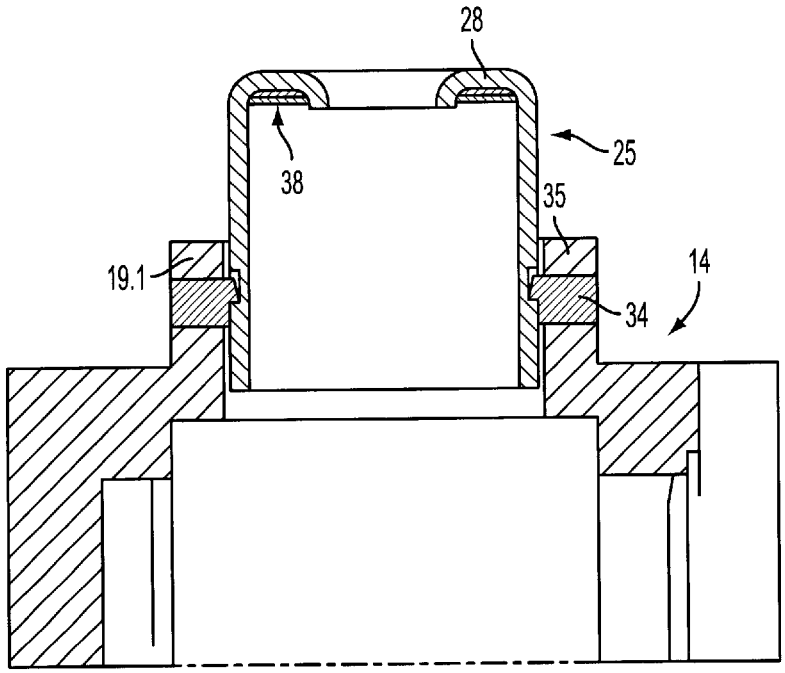
FIG. 9 is a sectional view taken along line IX—IX of FIG. 8.
Figure 10:
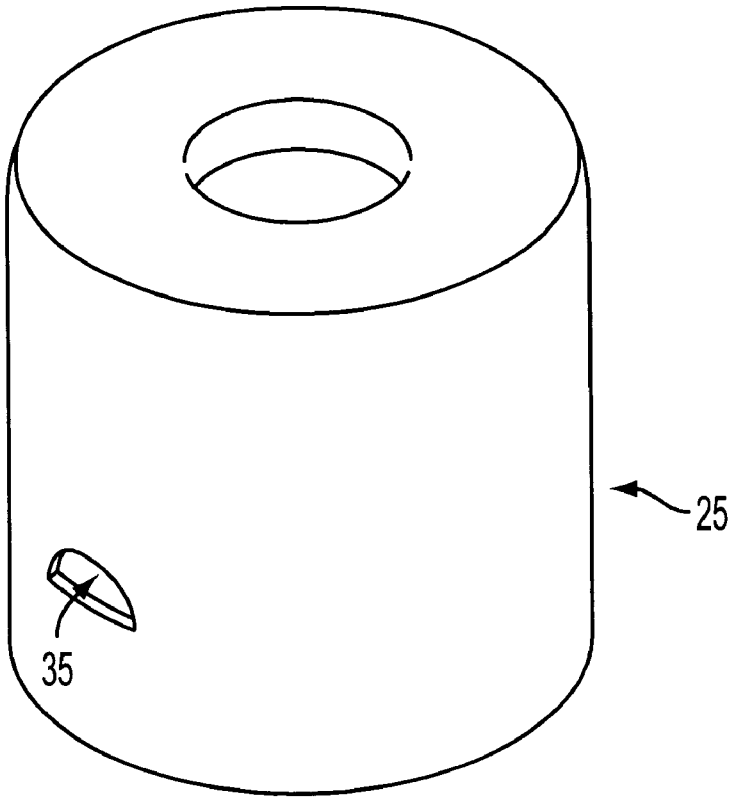
FIG. 10 is a perspective view of a support cap according to the embodiment shown in FIG. 8.

FIG. 8 is a perspective view of an embodiment in which the housing is provided with partial collar-like elevations 19.1 on its side oriented away from the housing cavity for the yoke body. As shown in FIG. 9, radial holding pins 34 pass through the elevations 19.1 and project into corresponding recesses 35 provided in the circumferential wall of the support cap 25. The recesses 35 may be through openings as shown in FIG. 10. For loosening the support cap the pins 34 are removed.

Figure 11:
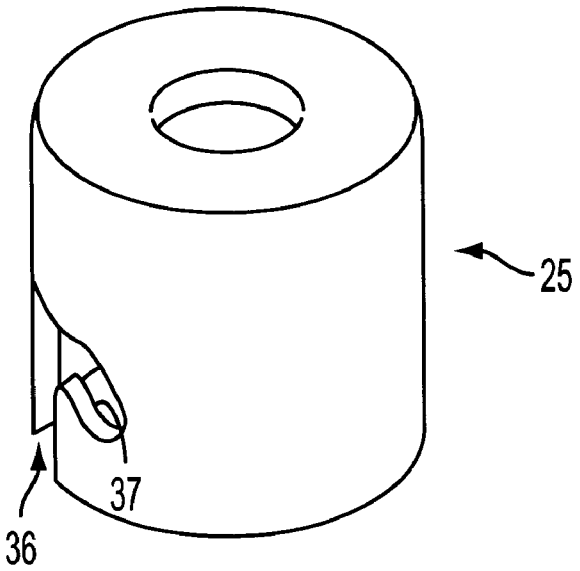
FIG. 11 is a perspective view of another preferred embodiment of the support cap for use in a housing shown in FIG. 8.

As shown in the variant illustrated in FIG. 11, it is also feasible to provide, in the circumferential wall of the support cap 25, a slit-like recess 36 having an approximately L-shaped course and terminating in a detent 37. Such a support cap may be inserted on the pins 34 affixed to the collar-like insert 19.1 and may be immobilized by rotation. Here too, the support cap 25 is held in its position by the bias of the opening spring 8.

In the embodiment according to FIGS. 9, 10 and 11 but also in all the previously described embodiments when suitably modified, the adjustment of the mid position of the armature 5 is effected by inserting and positioning on the base 28 of the support cap 25 one or more washers 38 of predetermined thickness before attaching the support cap 25 to the housing 14.

The adjusting washers 38 may also be used when for the adjustment of the mid position of the armature 5 only an insufficient setting path is available for the projection 27 on the helical ramp 31.

The wall thicknesses available for the housing 14 are sufficient to take up fluctuating stresses even if made of aluminum or aluminum die cast. The support cap 25 which should be thin-walled, is expediently made of steel sheet; for increasing the wear resistance, at least the base 28 is tempered to prevent the end of the opening spring from working itself into the base 28 during operation. Despite the thinness of the walls, the fluctuating spring forces acting between the housing 14 and the support cap 25 may be taken up as tension stresses via the steel plate material of the support cap 25.

The drawings readily show that the arrangement of projections and projection-receiving elements may be interchanged, that is, the through bore 18, instead of the groove-like receiving elements 26, may be provided with the radial projections 27 and, likewise, the support cap 25, instead of the projections, may be provided with the groove-like receptors.

It will be understood that the above description of the present invention is susceptible to various modifications, changes and adaptations, and the same are intended to be comprehended within the meaning and range of equivalents of the appended claims.

What is claimed is:

1. An electromagnetic actuator for operating a cylinder valve in an internal combustion engine; the actuator having a longitudinal axis and comprising (a) first and second housings secured to one another; each housing having a cavity and a through bore extending from said cavity;

(b) first and second electromagnets disposed in said cavity of respective said first and second housings; each said electromagnet having a yoke, a coil carried by said yoke and a pole face; the pole faces of said electromagnets being oriented toward and spaced from one another;

(c) an armature disposed between said pole faces for an axial reciprocation therebetween upon energization of said first and second electromagnets;

(d) a spring urging said armature away from said first electromagnet; said spring having an end oriented away from said armature;

(e) a support cap axially insertable in said through bore of said first housing; said support cap including a cap base having an inner face supporting said spring at said end thereof; and (f) locking means for securing said support cap to said housing; said locking means having at least one radially outwardly oriented projection from a surface of said cap, at least one axially oriented grove-like recess which is formed in a housing wall of the first housing defining said through bore, for receiving said at least one projection, and a circumferentially oriented receiving part in said housing for receiving the projection from the recess upon rotation of the cap, whereby said locking means is a bayonet lock.

2. The electromagnetic actuator as defined in claim 1, wherein at least one of said projection and said receiving part has a helically extending ramp related to said longitudinal axis and which is engaged by the other of said projection and said receiving part.

3. The electromagnetic actuator as defined in claim 1, further comprising immobilizing means for fixing said support cap in a predetermined angular position relative to said housing.

4. The electromagnetic actuator as defined in claim 1, wherein said cap base includes an element for receiving a mounting tool.

5. The electromagnetic actuator as defined in claim 1, wherein said support cap is made of deformed steel sheet.

6. The electromagnetic actuator as defined in claim 1, wherein said cap base is hardened.

7. The electromagnetic actuator as defined in claim 1, further comprising an adjusting washer positioned on said inner face of said cap base.

8. The electromagnetic actuator as defined in claim 2, wherein said projection and said receiving part have corresponding helically extending ramps related to said longitudinal axis.

9. The electromagnetic actuator as defined in claim 8, further comprising immobilizing means for fixing said support cap in a predetermined angular position relative to said housing.

10. The electromagnetic actuator as defined in claim 9, wherein said immobilizing means comprises a plurality of depressions formed in a surface of the ramp of one of said receiving part and said projection, and a plurality of corresponding protrusions formed in a surface of the other of the projection and said receiving part.

11. The electromagnetic actuator as defined in claim 2, further comprising immobilizing means for fixing said support cap in a predetermined angular position relative to said housing.

12. The electromagnetic actuator as defined in claim 11, further comprising an annular collar formed on an end surface of said first housing oriented away from the housing cavity for the yoke body and surrounding the through bore; and wherein said immobilizing means includes at least one recess in a circumferential surface of each of said cap and said collar, and a pin passing through said at least one recess in both said cap and said collar.

13. An electromagnetic actuator for operating a cylinder valve in an internal combustion engine; the actuator having a longitudinal axis and comprising (a) first and second housings secured to one another; each housing having a cavity and a through bore extending from said cavity;

(b) first and second electromagnets disposed in said cavity of respective said first and second housings; each said electromagnet having a yoke, a coil carried by said yoke and a pole face; the pole faces of said electromagnets being oriented toward and spaced from one another;

(c) an armature disposed between said pole faces for an axial reciprocation therebetween upon energizing said first and second electromagnets;

(d) a spring urging said armature away from said first electromagnet, with said spring having an end oriented away from said armature;

(e) a support cap axially insertable in said through bore of said first housing, with said support cap including a cap base having an inner face supporting said spring at said end thereof; and (f) locking means for securing said support cap to said housing, with said locking means comprising collar-like elevations disposed on a surface of said first housing facing away from the cavity for the respective yoke body and about the respective through bore, corresponding recesses formed in a circumferential surfaces of said elevations and of said cap, and at least one pin disposed in a recess in one of said elevations and projecting into a recess in said cap.

14. The electromagnetic actuator as defined in claim 13, wherein said at least one pin passes through the elevation and into the recess of the cap.

15. The electromagnetic actuator as defined in claim 13, wherein said at least one recess in said cap is substantially L-shaped with one arm of the recess extending to an edge surface of said cap oriented toward the respective cavity of the housing.

16. The electromagnetic actuator as defined in claim 13, wherein said cap base includes an element for receiving a mounting tool.

17. The electromagnetic actuator as defined in claim 13, wherein said support cap is made of deformed steel sheet.

18. The electromagnetic actuator as defined in claim 13, wherein said cap base is hardened.

19. The electromagnetic actuator as defined in claim 13, further comprising an adjusting washer positioned on said inner face of said cap base.

* * * * *